US009546480B2

(12) United States Patent
Jakobsen et al.

(10) Patent No.: US 9,546,480 B2
(45) Date of Patent: Jan. 17, 2017

(54) INSULATING ROOF SUPPORT ASSEMBLY, A METHOD OF INSTALLING SUCH ROOF SUPPORT ASSEMBLY AND AN INSULATING ROOF CONSTRUCTION

(71) Applicant: Rockwool International A/S, Hedehusene (DK)

(72) Inventors: Klavs Koefoed Jakobsen, Roskilde (DK); Preben Riis, Lejre (DK)

(73) Assignee: Rockwool International A/S, Hedehusene (DK)

( * ) Notice: Subject to any disclaimer, the term of this patent is extended or adjusted under 35 U.S.C. 154(b) by 0 days.

(21) Appl. No.: 14/896,490

(22) PCT Filed: May 28, 2014

(86) PCT No.: PCT/EP2014/061027
§ 371 (c)(1),
(2) Date: Dec. 7, 2015

(87) PCT Pub. No.: WO2014/195197
PCT Pub. Date: Dec. 11, 2014

(65) Prior Publication Data

US 2016/0130801 A1 May 12, 2016

(30) Foreign Application Priority Data

Jun. 7, 2013 (EP) ..... 13171005

(51) Int. Cl.
*E04B 1/00* (2006.01)
*E04B 1/76* (2006.01)
(Continued)

(52) U.S. Cl.
CPC ..... *E04B 1/7662* (2013.01); *E04B 1/665* (2013.01); *E04B 7/022* (2013.01); *E04D 3/36* (2013.01);
(Continued)

(58) Field of Classification Search
CPC ..... E04D 3/36; E04D 13/16; E04D 13/1612; E04D 13/1681; E04D 13/1625; E04D 13/1618; E04D 13/17; E04B 1/7662; E04B 1/665; E04B 7/022; E04B 7/18
See application file for complete search history.

(56) References Cited

U.S. PATENT DOCUMENTS 4,014,150 A * 3/1977 Wells ..... E04D 13/1637 52/461
4,058,949 A * 11/1977 Bellem ..... E04D 13/1618 52/407.1
(Continued)

FOREIGN PATENT DOCUMENTS

DE 2316956 A1 10/1974
DE 3937353 A1 5/1991
(Continued)

OTHER PUBLICATIONS

International Search Report and Written Opinion issued in co-pending international application No. PCT/EP2014/061027, dated Jul. 29, 2014.

*Primary Examiner* — Beth Stephan
(74) *Attorney, Agent, or Firm* — Dinsmore & Shohl LLP; Douglas L. Wathen

(57) ABSTRACT

The present invention concerns an insulating roof support assembly for a roof structure comprising a plurality roof elongated rafters spaced apart in a predetermined distance with insulation boards therebetween, wherein elongated mineral wool fiber insulation elements are provided on the top of each of the elongated roof rafters and elongated wooden elements on top of said insulation elements with at least one impermeable membrane between at least two
(Continued)

neighbouring insulation elements sandwiched between the wooden elements and the insulation elements.

17 Claims, 5 Drawing Sheets

(51) Int. Cl.
*E04D 3/36* (2006.01)
*E04D 13/16* (2006.01)
*E04B 1/66* (2006.01)
*E04B 7/02* (2006.01)

(52) U.S. Cl.
CPC ..... *E04D 13/1612* (2013.01); *E04D 13/1618* (2013.01); *E04D 13/1681* (2013.01)

(56) References Cited

U.S. PATENT DOCUMENTS 4,263,763 A * 4/1981 Bouwens ..... E04B 9/001 52/404.3
4,346,543 A * 8/1982 Wilson ..... E04D 3/3602 52/404.2
4,375,741 A * 3/1983 Paliwoda ..... E04D 13/1625 52/109
4,434,601 A * 3/1984 Zellmer ..... E04D 13/1625 52/407.1
4,651,489 A * 3/1987 Hodges ..... E04D 3/3602 52/409
4,843,774 A * 7/1989 Korsgaard ..... E04B 7/20 52/309.1
5,561,959 A * 10/1996 Alderman ..... E04D 15/06 52/404.1
8,959,856 B2 2/2015 Volkner et al.
2006/0218869 A1* 10/2006 Ellis ..... E04D 13/1618 52/309.9
2009/0293375 A1 12/2009 Schroer et al.
2011/0094175 A1* 4/2011 Groft ..... E04D 13/1618 52/302.1
2012/0102867 A1* 5/2012 Volkner ..... E04B 1/24 52/582.1

FOREIGN PATENT DOCUMENTS

DE 4309649 A1 7/1994
DE 202008007332 U1 8/2008
DE 202011100896 U1 8/2011
EP 0795659 A1 9/1997
EP 0909858 A2 4/1999
EP 2449182 A1 5/2012
SI WO 0238886 A1 * 5/2002 ..... E04D 13/1618

* cited by examiner

INSULATING ROOF SUPPORT ASSEMBLY, A METHOD OF INSTALLING SUCH ROOF SUPPORT ASSEMBLY AND AN INSULATING ROOF CONSTRUCTION

CROSS-REFERENCE TO RELATED APPLICATIONS

This application is the U.S. national phase of international patent application Ser. No. PCT/EP2014/061027, filed May 28, 2014, which claims priority to international patent application Serial No. EP 13171005.5, filed Jun. 7, 2013, the contents of which are incorporated herein in their entirety.

FIELD OF THE INVENTION

The present invention relates to a thermally insulating roof support assembly, a method of installing such roof support assembly and an insulating roof construction for buildings.

BACKGROUND OF THE INVENTION

It is known to provide an insulating roof support assembly for a roof structure comprising a plurality roof elongated rafters spaced apart in a predetermined distance with insulation boards there between. On top of this roof support assembly, the roof tiles or other types of roof cover is mounted.

It is also known to provide solutions for the new-build but as well for the refurbishment sector in order to deal with the constantly increasing requirements being specified in respect to thermal insulation respectively energy savings. Just by way of example reference is made to FIGS. 1 and 2 illustrating common solutions to deal with said increased demands. FIG. 1 showing a rafter extension as it would be required in order to improve existing buildings, i.e. for refurbishment; simply to increase the height of the existing rafters and hence the space to accommodate additional insulation; whereas FIG. 2 illustrates an on-rafter insulation system which actually would serve for both purposes, the new-build as well as for the refurbishment segment. Such systems have also earlier been described in e.g. EP0852275, DE19922592, or EP2354363.

In WO2009/153232 there is disclosed an insulating building system for an external building structure, such as a wall or a roof, or an internal building structure of the above-mentioned kind. This building assembly comprises a top and a bottom profile with a plurality of joining profiles between the top and bottom frame profiles. The joining profiles have a first and second side surfaces which are abutted by the contact sides of adjacent insulating panels on each side of said joining profiles, wherein the profile contact sides of the insulation panels are provided with a shape matching the profile side surfaces of the joining profiles such that the insulation panels are retained between two profiles. The insulation panels thereby support the joining profiles and provide stability and strength to the wall structure and prevent the joining profiles from buckling.

However, these known building assembly systems are often complex, not easy to install on a roof and furthermore, there are increasing demands for extra thermal insulation in roof constructions in order to provide a comprehensive thermal building insulation.

SUMMARY OF THE INVENTION

It is therefore an object by the present invention to provide a roof support assembly which is easy and fast to install on site and which allows for an efficient level of thermal insulation for avoiding thermal bridges in the roof construction.

This object is achieved by an insulating roof support assembly for a roof structure comprising a plurality of roof elongated rafters spaced apart in a predetermined distance with insulation boards there between, wherein elongated insulation elements are provided on the top of each of the elongated roof rafters and elongated wooden elements on top of said insulation elements with at least one impermeable membrane between at least two neighbouring insulation elements sandwiched between the wooden elements and the insulation elements.

By the invention, a roof support assembly may be provided which increases the insulation accommodating space between the roof rafters, but without extending thermal bridging by the wooden roof rafters. Due to the insulating properties of said insulation elements the thermal bridging is reduced compared to the use of similarly larger dimensioned rafters. The said insulation elements, like e.g. mineral wool fibre material, polymeric foams or other suitable insulation materials act as a thermal break or spacer. Moreover, the material is less expensive which results in a roof support construction which is inexpensive compared to the known solutions.

Today building requirements in many countries demand a roof insulation thickness of 400-500 mm. Existing roof constructions are not provided with rafters of such height and therefore an extension is needed when refurbishing the roof. By the roof support assembly according to the invention, a simple and cost-effective solution is provided.

Preferably, the elongated insulation elements are provided with the same width as the elongated roof rafters. Hereby the same dimensions of the insulation boards can be used for installation between the rafters and between the insulation respectively spacer elements.

In order to facilitate an easy mounting of the roof support assembly, the wooden elements, the at least one membrane and the elongated insulation elements are preferably mounted to the elongated rafters by a plurality of fastening members, such as screws.

By the invention it is found advantageous that the insulation elements have a sufficient rigidity and good load-carrying capability, in particular in a new-built situation, whilst at the same time being sufficient resilient so that any unevenness in the wooden rafters can be absorbed and the roof surface may thereby be aligned. The latter will often be a challenge faced in a refurbishment situation. Therefore, it is essential that the insulation elements or spacer provide a certain compression strength at 10% strain (CS(10)) according to European Standard EN826. In an embodiment of the invention the said compression strength at 10% strain will be in the range of 15 kPa to 30 kPa, preferably in the range of 20 kPa to 25 kPa. It is the person skilled in the art who will be able to choose the adequate strength properties in respect to the individual situation at the site. In some cases it might even be necessary to reduce the strength properties, e.g. by additional flexing of the bottom part of the insulation element which will be in contact with the wooden rafters, in order to be as resilient as to compensate for unevenness in a broad variety of tolerances.

In a preferred embodiment of the invention the elongated insulation elements are made from mineral wool fibre material, preferably stone wool fibre material. Moreover, it may be preferred that the mineral wool fibre insulation elements have a density of 70 kg/m$^3$ to 100 kg/m$^3$, preferably of 90 kg/m$^3$.

The roof structure in which the roof support assembly will typically be mounted may be an inclined roof, i.e. a pitched or steep roof, or a flat roof.

In a second aspect of the invention, there is provided a method of installing an insulating sub-roof assembly, said method comprising the steps of providing a plurality of roof elongated rafters with an elongated insulation element on the top of each of the elongated roof rafters and an elongated wooden elements on top of said insulation elements with at least one flexible membrane for waterproofing between at least two neighbouring insulation elements sandwiched between the wooden elements and the insulation elements. Such membranes for waterproofing are commercially available and regulated according to European Standard EN13859-1. In a preferred embodiment of the invention the membrane provides a variable diffusion-equivalent air layer thickness ($s_d$-value) of 0.01 m (depending on the moisture level) in accordance with European Standard EN12572 which ensures applicability of the membrane for a broad variety of different constructions.

By the invention, it is realised that the elongated insulation elements are mounted on the top of the rafters off-site. Hereby, the roof construction rafters may be prepared on the ground before being lifted to the roof, whereby a fast and easy insulating roof support assembly may be achieved.

However, it is also realised that the present invention is advantageous as the support roof assembly may be mounted on the roof rafters for refurbishment of an existing roof construction.

In yet a further aspect of the invention there is provided an insulating roof construction for buildings comprising a roof support assembly as described above and preferably provided by performing a method mentioned above. In the roof construction according to this aspect one or more insulation panels are provided in the space between the rafters and a top surface is mounted on the elongated wooden elements.

An insulating roof construction according to the invention is found advantageous as it is realised that it is possible to comply with e.g. the Passive House demands according to recommendations by the German Passive House Institute (PHI), Darmstadt as the roof construction can be provided with a U-value≤0.12 W/m$^2$K, in particular as low as 0.1 W/m$^2$K.

BRIEF DESCRIPTION OF THE DRAWINGS

In the following, the invention is described in more detail with reference to the accompanying drawings, in which.

DETAILED DESCRIPTION OF THE INVENTION

Figure 1:
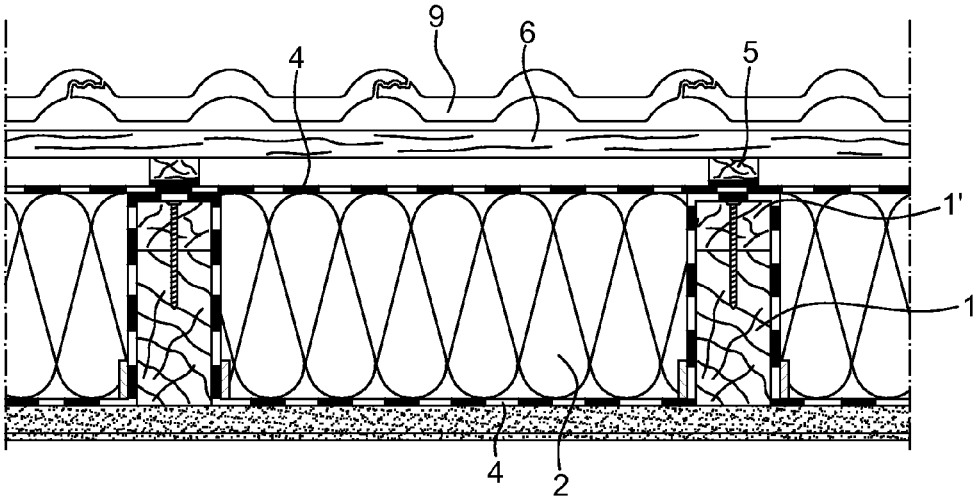
FIG. 1 PRIOR ART
FIGS. 1 and 2 are cross-sectional schematic views of roof constructions according to the prior art.
Figure 2:
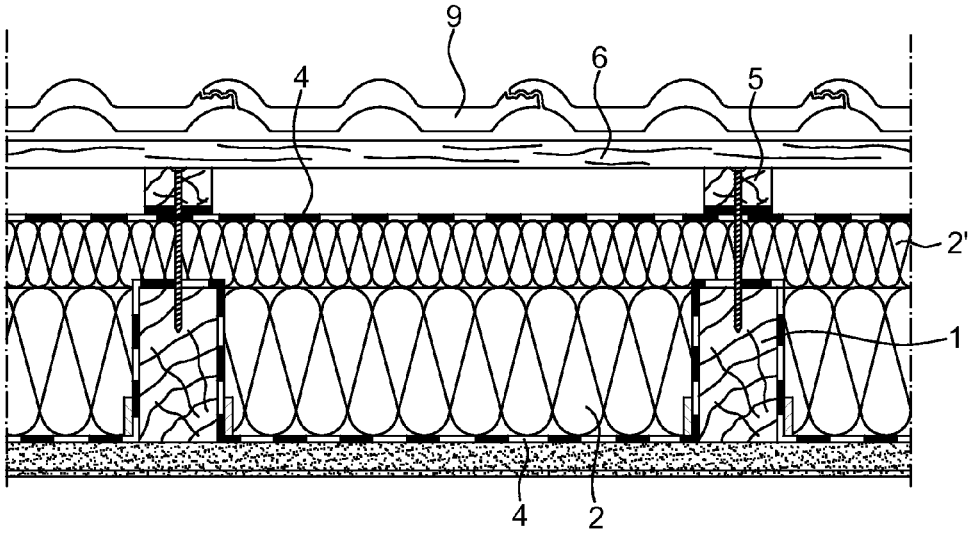
FIG. 2 PRIOR ART

FIGS. 1 and 2 show examples of known roof constructions. In FIG. 1, a number of wooden roof rafters 1 have been extended with additional wooden rafters 1'. Membranes 4 are fitted around the rafters and insulation boards 2 are then fitted between the rafters 1, 1' and a second membrane 4 is then provided on top of the rafters 1, 1'. The roof top structure is then mounted, i.e. the wooden support members 5 and the horizontally oriented laths 6 with roof tiles 9 or the like on top. In FIG. 2, there is no extension of the rafters 1 but instead a second layer of insulation 2' is provided.

Figure 3:
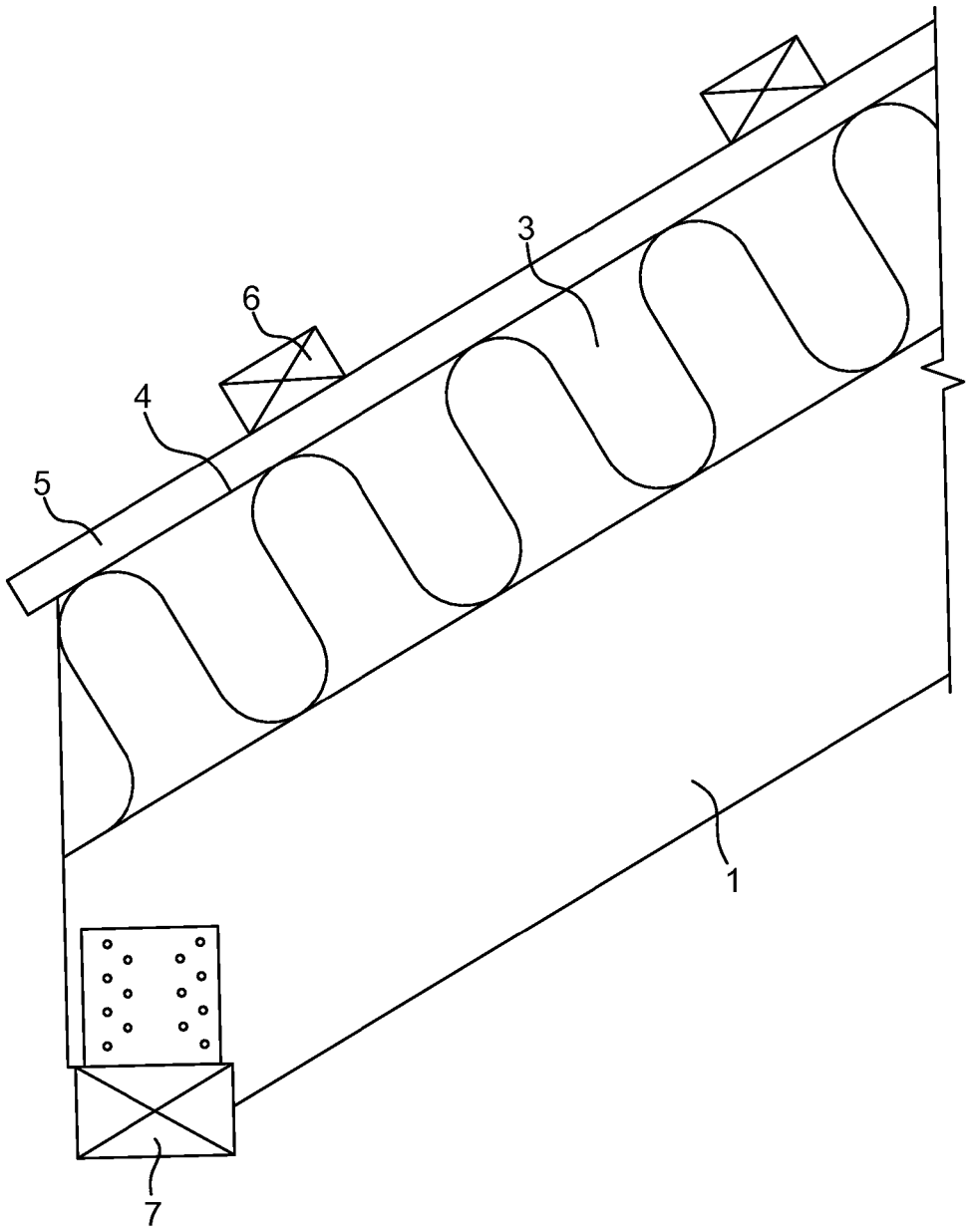
FIG. 3 is a schematic side view of an insulating roof support assembly according to an embodiment of the invention.
Figure 7:
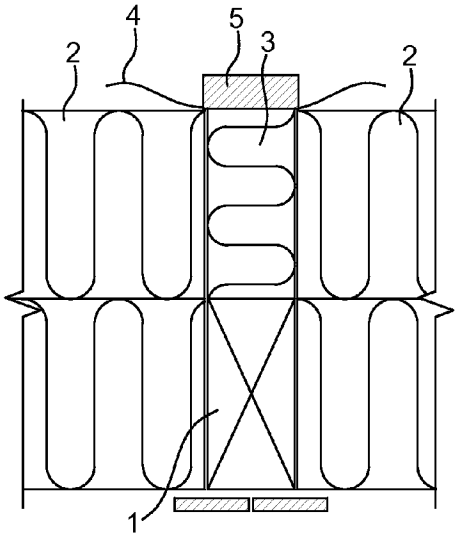
FIGS. 6 and 7 are two variants thereof where the insulation roof support assembly is assembled.
Figure 6:
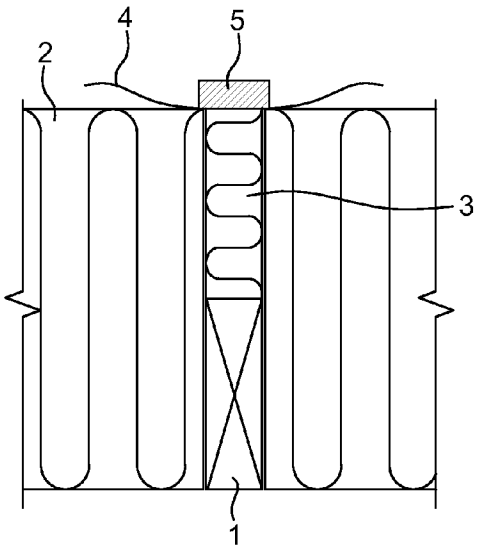
Figure 5:
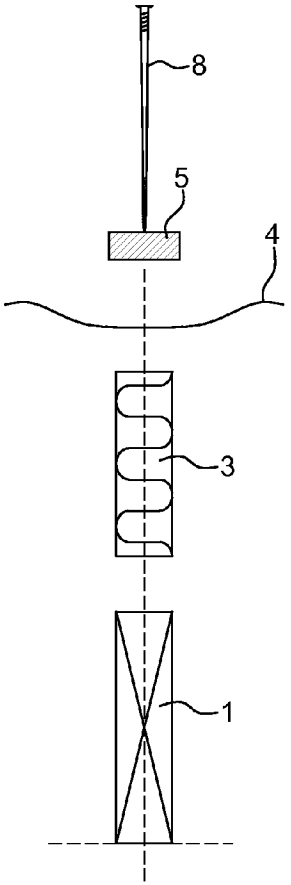
FIG. 5 is an exploded schematic front view of the insulating roof support assembly.

FIG. 3 shows an embodiment of the invention, where a roof rafter 1 is provided with an elongated mineral wool fibre insulation element 3 on the top of the rafter (see also FIGS. 5-7). A flexible membrane 4 for waterproofing as it has been described before is provided on top of the elongated insulation element 4. A wooden support member 5, e.g. a Kerto board is then placed above the insulating spacer element 3 thereby clamping the membrane 4 between the insulation spacer 3 and the support member 5 when the assembly is mounted via glue and/or fastening screws 8 (see FIGS. 5-7) penetrating the membrane 4 and the spacer elements 3. On the support members 5 a number of horizontally oriented laths 6 are provided onto which the roof cover (not shown) can be mounted.

The rafters 1 and thereby the roof construction are fixed to a wall plate 7 on the top of the wall of the building.

Figure 4:
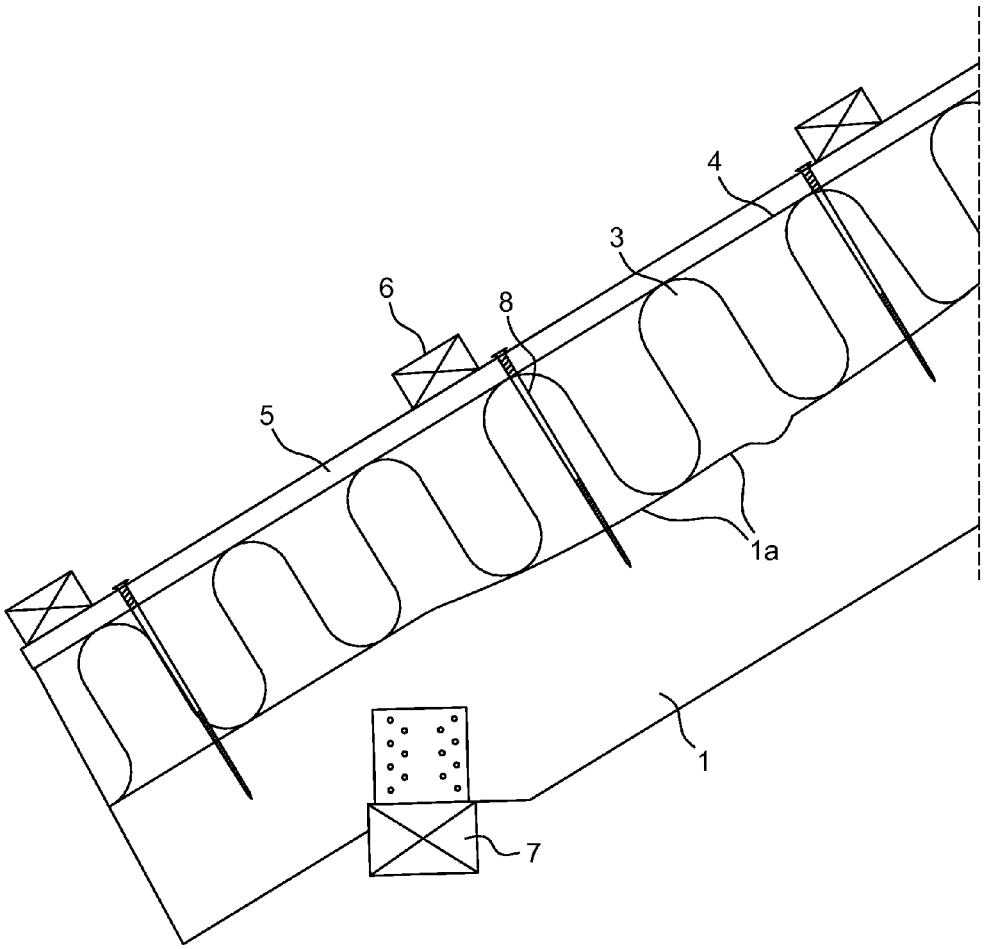
FIG. 4 is another embodiment thereof.

As shown in FIG. 4, the insulating roof support assembly according to the invention may be mounted on rafters 1 of an existing roof construction. The mineral wool fibre spacer elements 3 may due to their resiliency absorb any unevenness 1*a* on the top surface of the rafters 1 so that when the spacer elements 3 are mounted the top wooden member 5 becomes aligned with the roof inclination. Said spacer elements 3 are mounted together with the support members 5 and the membrane 4 via fastening screws 8 as described before. In case of considerable unevenness 1*a* of the rafters 1 it might be adequate to apply additional flexing to the bottom part of the spacer elements by means per se known in the art to influence the resiliency to the extent needed. This "extra flexing" for refurbishment situations makes the roof support assembly according to the invention particularly advantageous.

The mineral wool fibre spacer elements 3 advantageously provide a very low thermal conductivity, expressed as the Lambda declared value according to EN13162 of between 0.030 W/mK and 0.035 W/mK, preferably of about 0.034 W/mK.

As indicated in FIGS. 6 and 7, insulation boards 2 may be provided between two adjacent rafters 1 with an insulating spacer element 3 mounted thereon. The insulation boards 2 may be traditional low-density mineral wool insulation boards as they are commonly known, being installed in one or more layers in order to provide the predetermined thickness of the thermal insulation required for the roof system.

The rafters 1 are normally made of wood and are normally part of the roof construction sections. When providing a roof construction to a new building, the insulating spacer elements 3 may advantageously be mounted as extensions on the rafters 1 during the production of the rafter sections. Advantageously, the insulating spacer elements 3 are provided with the same width dimensions as the rafter 1 (as shown in FIGS. 6 and 7). This makes the fitting of the insulation boards easy and simple.

EXAMPLE

The main purpose of the roof solution in a modern building is to have a balanced and efficient thermal performance defined by the U-value or overall heat transfer coefficient. This value indicates the rate of heat transfer through a specific component over a given area if the temperature difference is exactly one degree (1 Kelvin). The measurement unit of the U-value is therefore $W/m^2K$; the smaller the U-value the better the level of insulation.

With a system according to the invention it is found possible to complete a coherent un-broken fibrous insulation shell. A shell ensuring that the buildings structural parts are efficient protected and thermally well insulated. The building envelope does not impair the thermal performance significantly, except for those necessary penetrations that must be handled separately.

Figure 8:
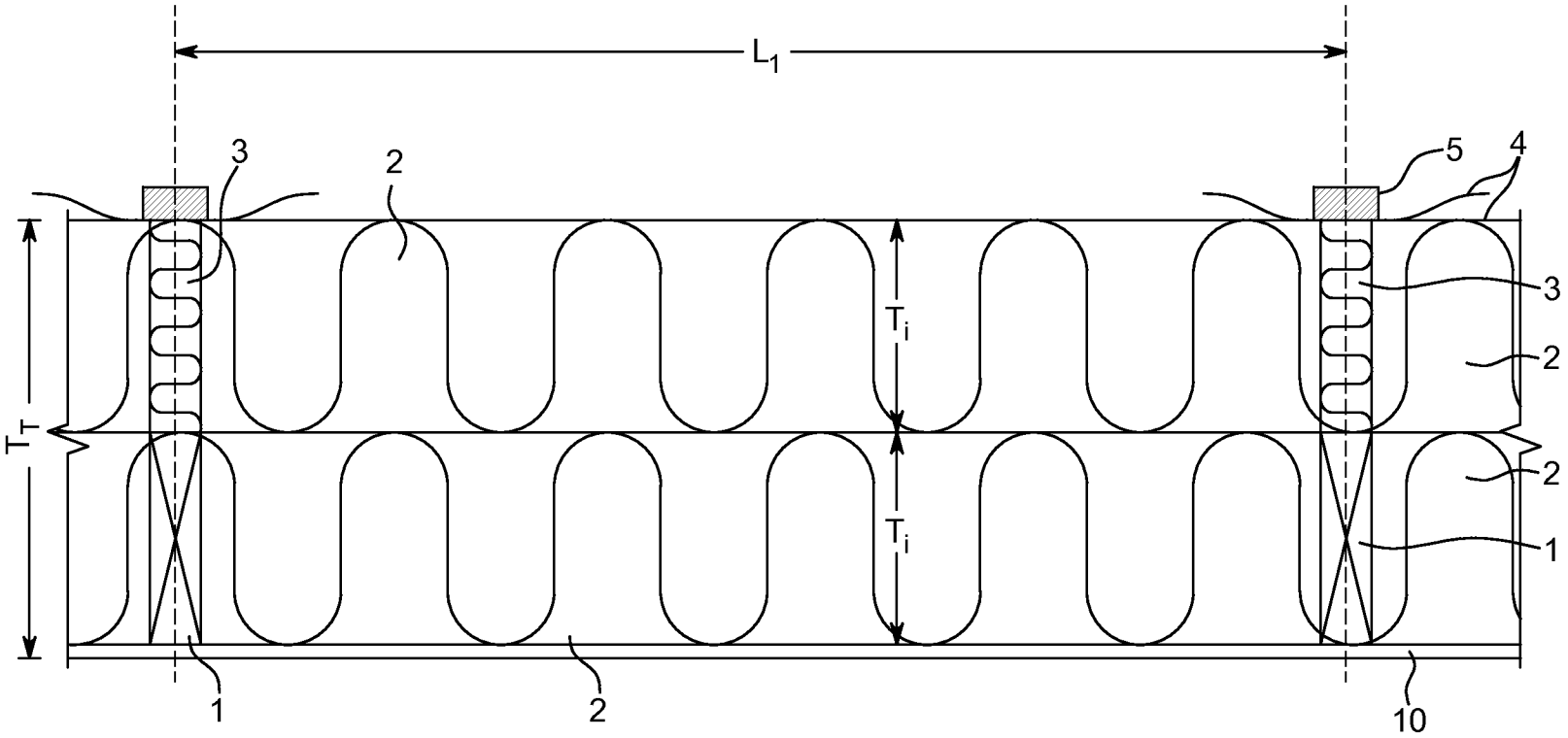
FIG. 8 is a schematic cross-sectional view of the roof support assembly of example described below.

As an example of the thermally insulated roof support assembly, shown in FIG. 8, the system is made of components described below.

Wooden rafters 1 are provided at an axial distance ($L_1$) of 1.000 mm, having a density of approx. 500 $kg/m^3$, and with a width of 45 mm, a height of 180 mm and a Lambda value of 0.12 W/mK (at approx. 12% moisture content).

The spacer elements 3 on top of rafters 1 are made of mineral wool fibres with a density of 90 $kg/m^3$ and with a width of 45 mm, a height of 180 mm and a Lambda declared value of 0.034 W/mK according to EN13162.

The intermediary insulation boards 2 are of the type Super flexibatts® produced by Rockwool A/S and with a thickness of 180 mm ($T_i$) and a Lambda declared value of 0.034 W/mK according to EN13162.

The rafters 1 are provided on a layer of wooden fibre boards 10 of the OSB type having a density of approx. 650 $kg/m^3$, a thickness of 12 mm and a Lambda value of 0.13 W/mK.

By choosing the above described design and the said materials, the total thickness of the roof support is 372 mm in order to achieve a total U-value of 0.10 $W/m^2K$.

The invention claimed is:

1. An insulating roof support assembly for a roof structure, comprising:

a plurality of roof elongated rafters spaced apart by a predetermined distance; with insulation boards disposed between the plurality of roof elongated rafters;

an elongated insulation element disposed on top of each of the elongated roof rafters, the elongated insulation elements each having a width that is the same as a width of the elongated roof rafters and parallel thereto;

elongated wooden elements disposed on top of said insulation elements;

at least one flexible membrane for waterproofing extending between at least two of said insulation elements, the at least one flexible membrane being sandwiched between the wooden elements and the insulation elements.

2. The insulating roof support assembly for a roof structure according to claim 1, wherein the insulation boards have a total thickness that is the same as the combined thickness of the elongated roof rafters and the elongated insulation element.

3. The insulating roof support assembly according to claim 1, wherein the elongated insulation elements provide a compression strength at 10% strain (CS(10)) in the range of 15 kPa to 30 kPa.

4. The insulating roof support assembly according to claim 1, wherein the membrane provides a specific variable diffusion-equivalent air layer thickness (sd-value) of 0.01 m.

5. The insulating roof support assembly according to claim 1, wherein the wooden elements, the at least one membrane and the elongated insulation elements are mounted to the elongated rafters by a plurality of fastening members.

6. The insulating roof support assembly according to claim 1, wherein the elongated insulation elements are made from mineral wool fiber material.

7. The insulating roof support assembly according to claim 6, wherein the mineral wool fiber insulation elements have a density of 70 $kg/m^3$ to 100 $kg/m^3$.

8. The insulating roof support assembly according to claim 6, wherein the Lambda declared values are:

approx. 0.12 W/mK for the roof rafters;

approx. 0.034 W/mK for the spacer elements; and approx. 0.034 W/mK for the insulation boards.

9. The insulating roof support assembly according to claim 1, wherein the roof structure is an inclined roof.

10. The insulating roof construction for buildings comprising a roof support assembly according to claim 1.

11. The roof construction according to claim 10, which has a total U-value of ≤0.12 $W/m^2K$.

12. The insulating roof construction according to claim 10, wherein one or more insulation boards are provided in a space between the rafters.

13. The insulating roof support assembly for a roof structure according to claim 1, wherein the elongated insulation boards are further disposed between the elongated insulation elements.

14. The insulating roof support assembly for a roof structure according to claim 1, wherein the insulation elements have a density greater than a density of the insulation boards.

15. A method of installing an insulating roof support assembly, said method comprising the steps of:

on a plurality of roof elongated rafters spaced apart by a predetermined distance, providing an elongated insulation element on top of each of the elongated roof rafters, the elongated insulation elements each having a width that is the same as a width of the elongated roof rafters and parallel thereto; and providing elongated wooden elements on top of said insulation elements with at least one membrane extending between at least two neighboring insulation elements and sandwiched between the wooden elements and the insulation elements.

16. The method according to claim 15, further comprising mounting the elongated insulation elements on the top of the rafters off-site.

17. The method according to claim 9, further comprising mounting the support roof assembly on the roof rafters for refurbishment of an existing roof construction.

* * * * *